US007110708B2

(12) United States Patent
Jeon

(10) Patent No.: US 7,110,708 B2
(45) Date of Patent: Sep. 19, 2006

(54) DEVELOPING CARTRIDGE FOR ELECTROPHOTOGRAPHIC IMAGE FORMING APPARATUS

(75) Inventor: In-cheol Jeon, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 171 days.

(21) Appl. No.: 10/873,108

(22) Filed: Jun. 23, 2004

(65) Prior Publication Data

US 2005/0117937 A1 Jun. 2, 2005

(30) Foreign Application Priority Data

Dec. 1, 2003 (KR) ..... 10-2003-0086250

(51) Int. Cl.
*G03G 15/08* (2006.01)

(52) U.S. Cl. ..... 399/260; 399/262

(58) Field of Classification Search ..... 399/107, 399/111, 119, 120, 252, 258, 260, 262; 222/DIG. 1
See application file for complete search history.

(56) References Cited

U.S. PATENT DOCUMENTS 5,579,101 A 11/1996 Omata et al.
5,890,034 A * 3/1999 Nakano et al. ..... 399/106
6,219,505 B1 * 4/2001 Sato et al. ..... 399/98

FOREIGN PATENT DOCUMENTS

| | | |
|---|---|---|
| JP | 2002-244422 | 8/2002 |
| JP | 2002-278272 | 9/2002 |
| JP | 2002-341638 | 11/2002 |

* cited by examiner

*Primary Examiner*—Hoan Tran
(74) *Attorney, Agent, or Firm*—Staas & Halsey LLP

(57) ABSTRACT

A developing cartridge for an electrophotographic image forming apparatus includes, a toner housing, a toner storage chamber, a toner feeding chamber, a feeding roller, a developing roller and a shielding device. One side of the toner housing has an opening, and the toner storage chamber and the toner-feeding chamber communicate with each other through a communication hole. The shielding device is installed within the toner storage chamber so as to move from a shielding position where it shields the communication hole to an opening position where it opens the communication hole. Accordingly, since the shielding member is capable of moving within the toner storage chamber, the user can save trouble of separating and removing the shielding member from the toner housing.

26 Claims, 8 Drawing Sheets

DEVELOPING CARTRIDGE FOR ELECTROPHOTOGRAPHIC IMAGE FORMING APPARATUS

CROSS-REFERENCE TO RELATED APPLICATIONS

This application claims the benefit of Korean Application No. 2003-86250, filed Dec. 1, 2003, in the Korean Intellectual Property Office, the disclosure of which is incorporated herein by reference.

BACKGROUND OF THE INVENTION

1. Field of the Invention

The present invention relates to an electrophotographic image forming apparatus. More particularly, the present invention relates to a developing cartridge for an electrophotographic image forming apparatus.

2. Description of the Related Art

As is well known in the art, an electrophotographic image forming apparatus is a printing apparatus, in which a toner is deposited on a photosensitive medium, where an electrostatic latent image is formed when a laser beam scans the photosensitive medium, thereby forming a toner image, and transferring the toner image to a paper being fed. Accordingly, a desired image is printed out. Since the electrophotographic image-forming apparatus has to be continuously fed with the toner, the electrophotographic image forming apparatus is usually provided with a separate toner storage means. The toner storage means is detachably mounted to the image forming apparatus body for replacement.

FIG. 1 is a schematic illustrating a conventional electrophotographic image forming apparatus. Referring to FIG. 1, the conventional electrophotographic image forming apparatus 100 comprises an exposure device 110, a developing cartridge 200, a transfer roller 120, a fixation device 130 and a paper-feeding device 140.

In the electrophotographic image forming apparatus 100 as constructed above, when a printing command is applied to the image forming apparatus 100, a laser beam in the exposure device 110 scans photosensitive drum 221 provided within the developing cartridge 200. Then, an electrostatic latent image is formed on the surface of the photosensitive drum 221, and the toner is deposited on the electrostatic latent image, thereby forming a toner image. When a paper is fed from the paper-feeding device, the toner image formed on the photosensitive drum 221 is transferred to the paper by the transfer roller 120. The toner image transferred to the paper is fixed on the paper as the paper passes through the fixation device 130.

In the above construction, the developing cartridge 200 has a predetermined lifespan, and is detachably mounted to the image forming apparatus body 101 for replacement.

As shown in FIG. 2, the conventional developing cartridge 200 is generally divided into a toner housing 210 and a photosensitive drum housing 220.

The toner housing 210 comprises a hopper housing 211 and a developing housing 212. The hopper housing 211 is provided with a toner storage chamber 211*a*, into which a toner is charged. A toner feeding chamber 212*a* is provided within the developing housing 212, and an agitator 213, a feeding roller 214 and a developing roller 215 are provided within the toner feeding chamber 212*a*. The toner feeding chamber 212*a* is opened to feed the toner to the photosensitive drum housing 220, in which the opened part is shielded by the developing roller 215, a restraint blade 216 and a shielding membrane 217. In addition, a photosensitive drum 221 and an electrification roller 222 for electrifying the photosensitive drum 221 are provided within the photosensitive drum housing 220.

The above-constructed conventional developing cartridge 200 is tested by examining an image produced using the developing cartridge 200, after the photosensitive drum housing 220 and the developing housing 212 are assembled, and a small amount of toner is fed thereto, while being manufactured.

If the developing cartridge 200 is in good order, a hopper housing 211 filled with toner is assembled to the developing housing 212. At that time, a shielding film 230 seals the toner storage chamber 211*a* of the hopper housing 211*a* to prevent leakage of the toner. If the toner storage chamber 211*a* communicates with the toner feeding chamber 212*a*, the pressure of toner moving to the opened part of the toner feeding chamber 211*a* increases. As a result, the toner may leak out due to vibration or external impact that can be caused during the transportation of the developing cartridge 200.

As can be appreciated from the above, in the conventional cartridge 200, the toner storage 211*a* and the toner feeding chamber 212*a* are partitioned by the shielding film, and therefore, the toner feeding chamber 212*a* is not used. Therefore, there is a limit in space for storing toner, which shortens a life span of the developing cartridge 200. In order to increase the toner-storing space, the size of the hopper housing 211 can be increased. However, this approach is not preferable since it will also increase the whole size of the image forming apparatus 100.

In addition, inconvenience will be caused when using the conventional cartridge 200 because a user has to detach and remove the shielding film 230 before mounting the cartridge to the image forming apparatus body 101. Furthermore, when the shielding film 230 is removed, the toner adhered to the shielding film 230 may be dispersed, thereby contaminating surroundings.

SUMMARY OF THE INVENTION

Accordingly, the present invention has been made to solve the above and/or other mentioned problems occurring in the prior art, and an aspect of the present invention is to provide a developing cartridge for an electrophotographic image forming apparatus, improved in construction to facilitate a use of the developing cartridge and to increase the space for storing toner without increasing the size of the developing cartridge.

In order to achieve the above aspect, there is provided a developing cartridge for an electrophotographic image forming apparatus including a toner housing, a toner storage chamber, a toner feeding chamber, a feeding roller, a developing roller and a shielding device or guarding device, wherein an opening is formed on one side of the toner housing and the toner storage chamber and the toner feeding chamber communicating with each other through a communication hole. The shielding device or guarding device is installed within the toner storage chamber to be displaceable from a shielding or guarding position where the shielding device shields the communication hole to an open position where the shielding device opens the communication hole.

According to an embodiment of the present invention, the shielding or guarding device includes a rotary shaft, a shielding or guarding member and a compression projection. The shielding or guarding member consists of a shielding section for shielding the communication hole, and at least one swivel supporting section connected to the shielding section to be elastically deformable, in which the swivel supporting section is provided with a shape-mating hole. The swivel supporting section is elastically deformed by the compression projection in the shielding position, by which the shape-mate hole can be mated with the shape-mating part. If the rotary shaft rotates, the swivel supporting section also rotates in cooperation with the rotary shaft, breaks away from the compression projection, and then elastically returns to its original shape. Thus, the swivel supporting section can be disengaged from the rotary shaft.

A fixing projection may be provided on an inner wall of the toner housing to prevent the swivel supporting section disengaged from the rotary shaft from rotating.

The rotary shaft may be also provided with an agitator.

According to another embodiment of the present invention, the shielding or guarding device comprises a guide wall and a shielding or guarding member. The shielding or guarding member consists of a shielding section and a head section. The guide wall forms a guide slot along with the inner wall of the toner housing, and the shielding member while shielding the communication hole can be lifted along the guide slot, thereby opening the communication hole.

A throughhole is formed at one side of the toner housing. The head section may be connected to an operation cable exposed to the outside of the toner housing through the throughhole.

In addition, a sealing member is provided on at least one of the inner and outer portions of the toner housing to seal the throughhole.

The developing cartridge may also include a restraint blade and a shielding or guarding membrane. The restraint blade shields a part of the opening along with the developing roller. The shielding or guarding membrane shields or guards the remaining part of the opening along with the developing roller.

Furthermore, the developing cartridge according to an embodiment of the present invention may comprise a photosensitive drum housing, a photosensitive drum and an electrification roller which are installed within the photosensitive drum housing.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
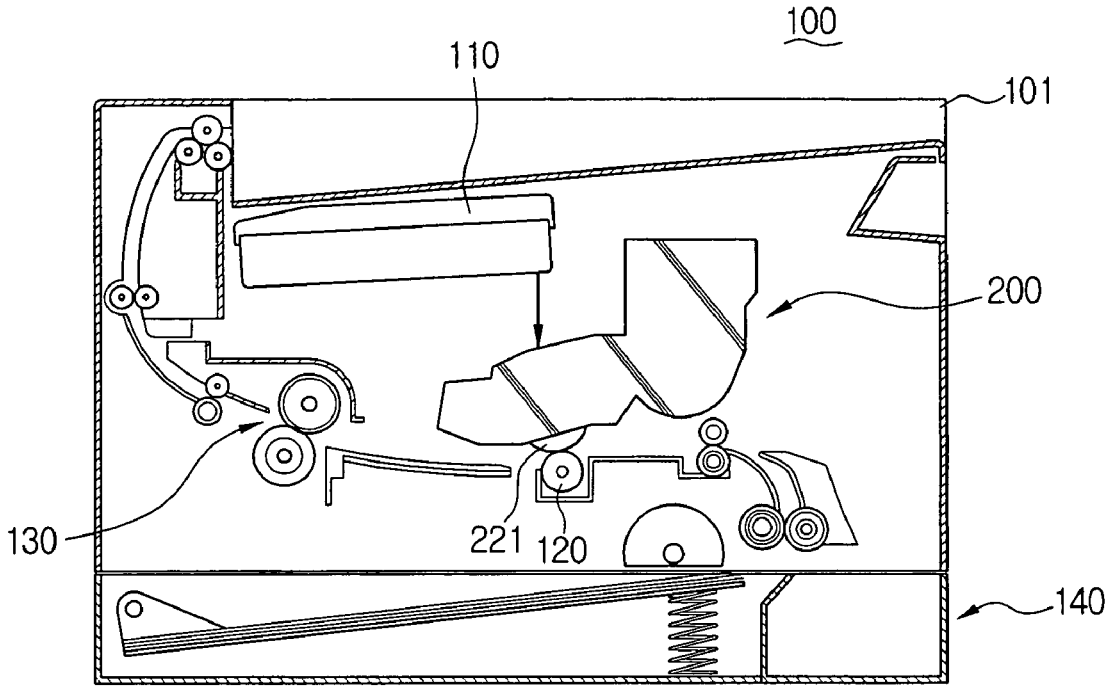
FIG. 1 (PRIOR ART)
FIG. 1 is a view illustrating a construction of a conventional electrophotographic image forming apparatus.
Figure 2:
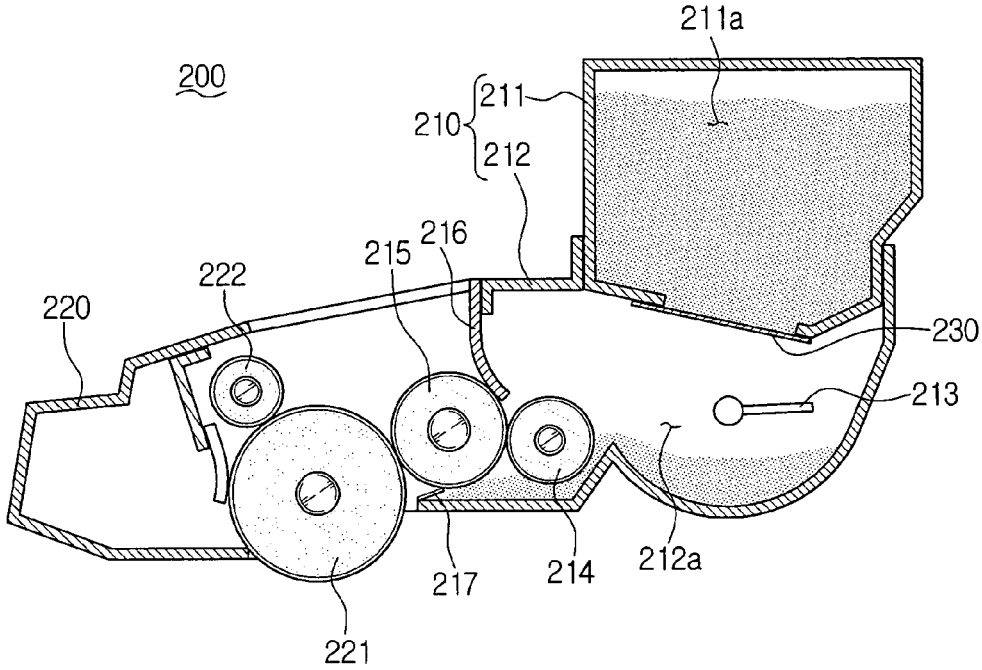
FIG. 2 (PRIOR ART)
FIG. 2 is a view illustrating a construction of a developing cartridge for the conventional electrophotographic image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinbelow, a developing cartridge for an electrophotographic image forming apparatus will be described in detail with reference to the accompanying drawings.

Figure 3:
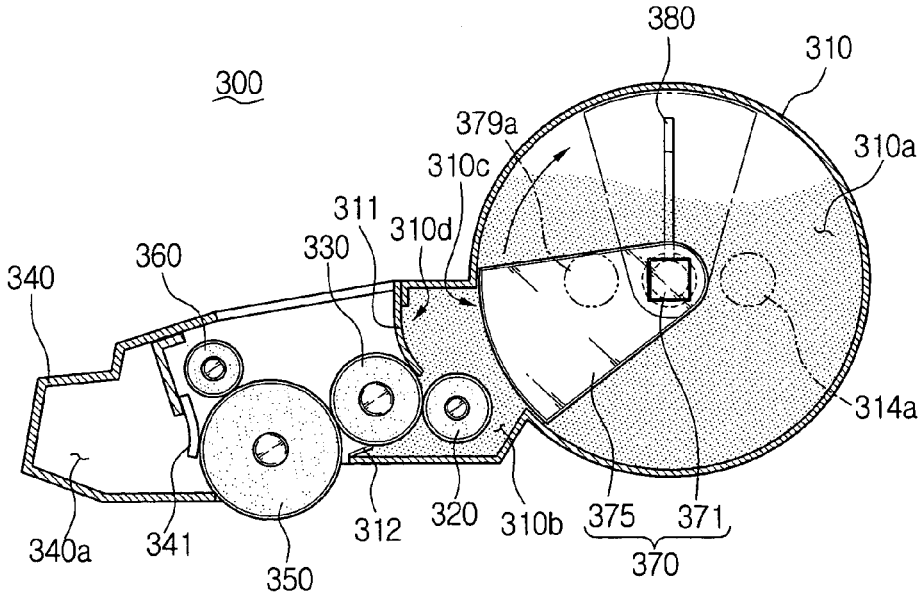
FIG. 3 is a view illustrating a construction of a developing cartridge for an electrophotographic image forming apparatus, according to an embodiment of the present invention.

As shown in FIG. 3, a developing cartridge 300 for an electrophotographic image forming apparatus comprises a toner housing 310, a feeding roller 320, a developing roller 330, a photosensitive drum housing 340, a photosensitive drum 350 and a shielding device 370.

Figure 4:
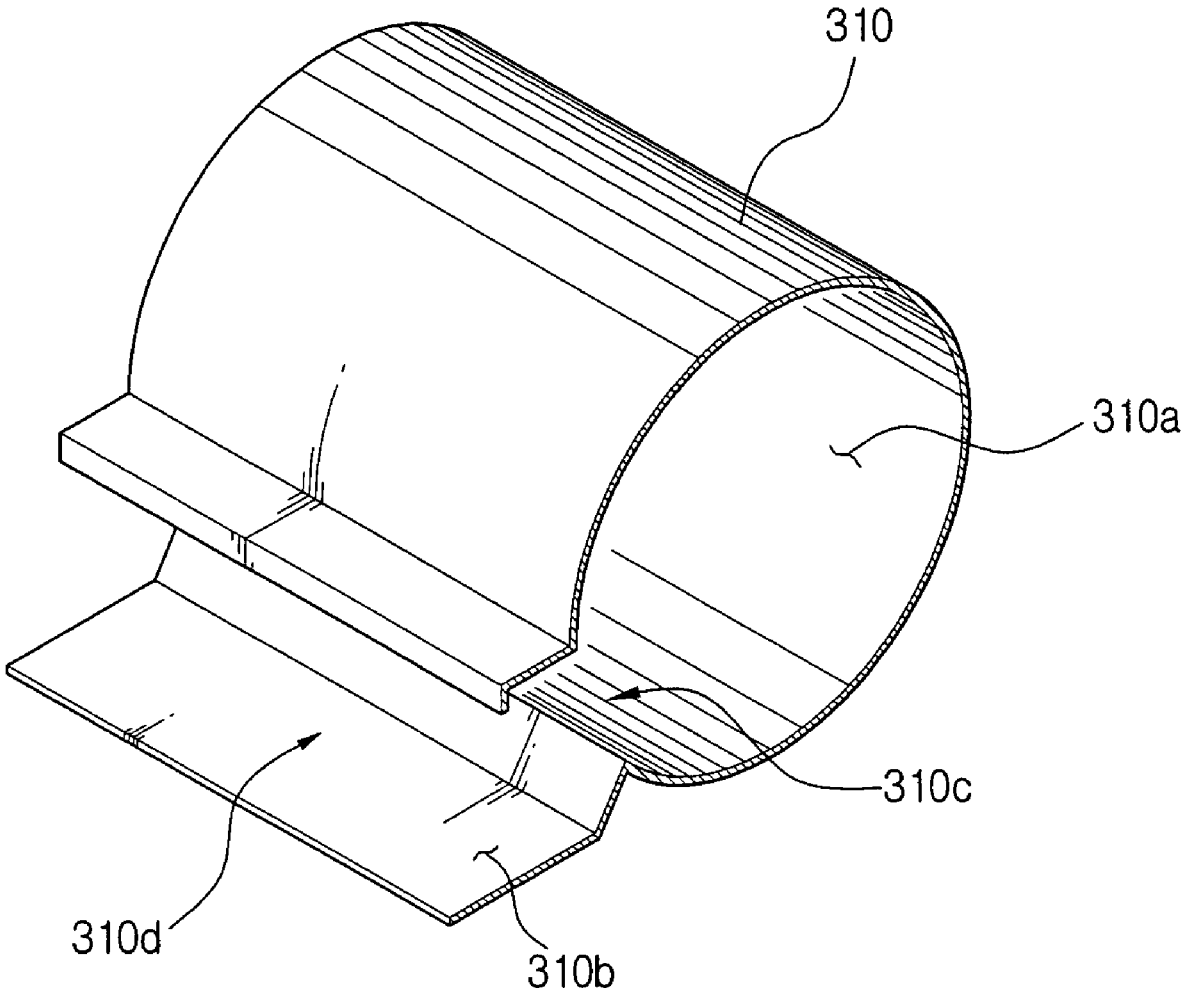
FIG. 4 is a perspective view of a toner housing extracted from the developing cartridge according to an embodiment of the present invention.

The toner housing 310 is provided with a toner storage chamber 310*a* and a toner feeding chamber 310*b* as shown in FIG. 4. The toner storage chamber 310*a* and the toner feeding chamber 310*b* communicate with each other through communication hole 310*c*. The toner storage chamber 310*a* is filled with a toner, and the toner moves to the toner feeding chamber 310*b* through the communication hole 310*c*. An opening 310*d* is formed in one side of the toner feeding chamber 310*b*. The toner within the toner feeding chamber 310*b* can move out of the toner housing 310 through the opening 310*d*.

The feeding roller 320 deposits the toner onto the surface of the developing roller 330 in which the feeding roller 320 is rotatably installed in the toner feeding chamber 310*b*.

The developing roller 330 is installed in the opening 310*d* to be in contact with the feeding roller 320. A restraint blade 311 is installed above the developing roller 330. The restraint blade 311 restrains the thickness of toner deposited on the surface of the developing roller 330, and shields an upper part of the opening 310*d* together with the developing roller 330, to prevent the toner within the toner-feeding chamber 310*b* from flowing out of the toner-feeding chamber 310*b*. Under the developing roller 330, a shielding membrane 312 is provided to be in contact with the developing roller 330. The shielding membrane 312 shields the lower part of the opening 310*d* together with developing roller 330, thereby preventing the toner within the toner-feeding chamber 310*b* from flowing out of the toner-feeding chamber 310*b*.

The photosensitive drum housing 340 is connected to one end of the toner housing 310 covering the opening 310*d* of the toner housing 310, as shown in FIG. 3, and one side of the photosensitive drum housing 340 is formed with a waste toner collection chamber 340*a*. One side of the interior of the photosensitive drum housing 340 is provided with the photosensitive drum 350 to be in contact or not with the developing roller 330. The photosensitive drum 350 is fed with the toner through the developing roller 330. A part of the photosensitive drum 350 is exposed to the outside of the photosensitive drum housing 340, and a toner image formed on the surface of the photosensitive drum 350 is transferred to a paper from the exposed part. In addition, one side of the interior of the toner housing 310 is provided with an electrification roller 360 for electrifying the surface of the photosensitive drum 350 and to be in contact with one side of the photosensitive drum 350. Furthermore, the other side of the toner housing 310 is provided with a cleaning blade 341 so that the cleaning blade 341 is in contact with the other side of the photosensitive drum 350, in order to remove the toner remaining on the surface of the photosensitive drum 350 not being transferred to the paper. The toner removed from the photosensitive drum 350 by the cleaning blade 341 is collected into the waste toner collection chamber 340*a*.

According to the present invention, the toner housing 310 and the photosensitive drum housing 340 may be formed in a single chamber. In that case, the toner housing 310 and the photosensitive drum housing 340 may be defined with respect to the opening 310*d* of the toner feeding chamber 310*b*.

Figure 5:
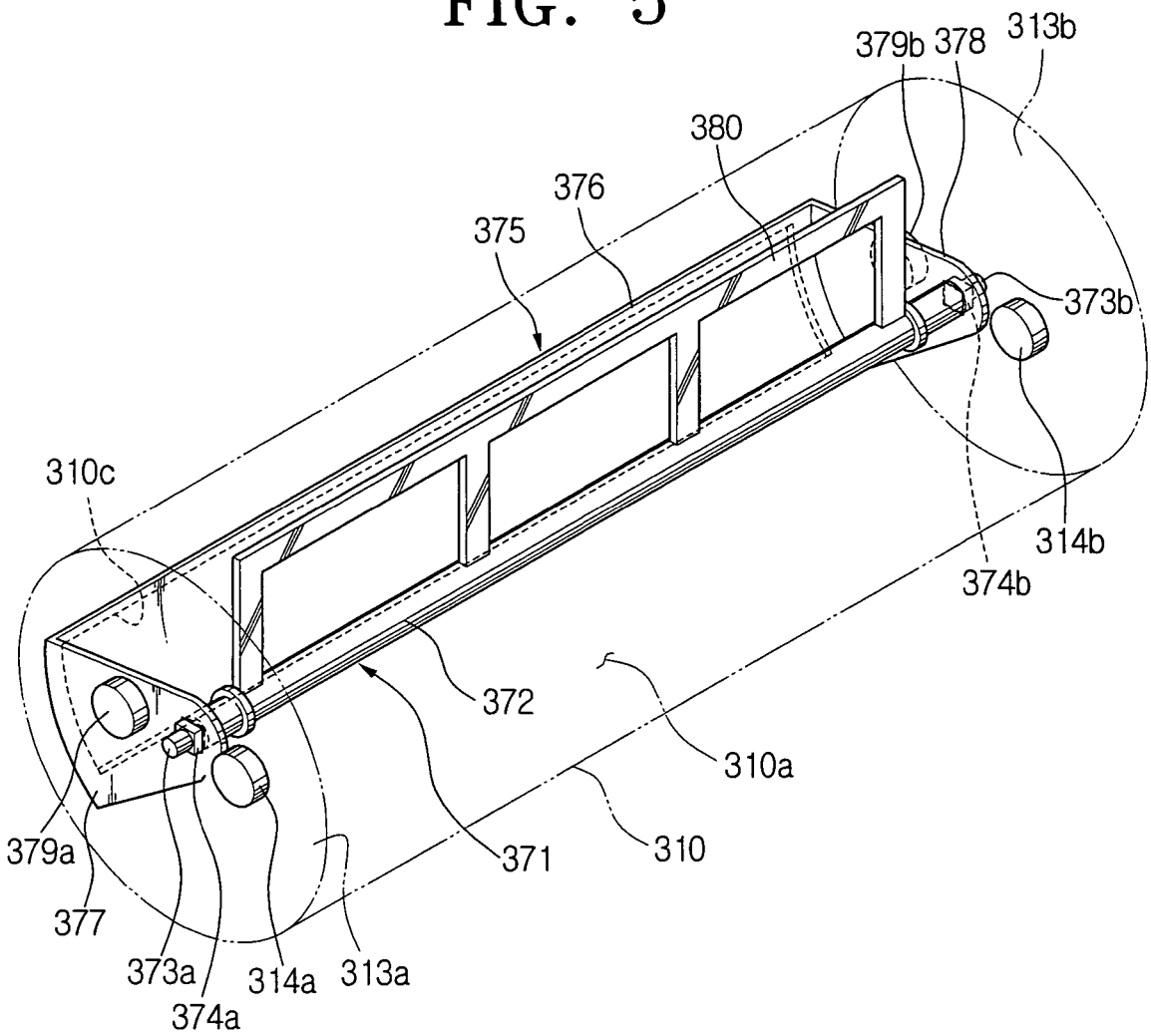
FIG. 5 is a perspective view of main parts extracted from the developing cartridge according to an embodiment of the present invention.

The shielding device 370 comprises a rotary shaft 371, a shielding member 375 and compression projections 379*a*, 379*b* (FIG. 5). The shielding device 370 is included within the toner storage chamber 310*a*.

As shown in FIG. 5, the rotary shaft 371 comprises a large diameter part 372 and small diameter parts 373*a*, 373*b*, and shape-mating parts 374*a*, 374*b*. The rotary shaft is rotatably supported by the opposite inner lateral walls 313*a*, 313*b* of the toner housing 310. Although not shown, at least one of the small diameter parts 373*a*, 373*b*, which are the opposite end parts of the rotary shaft 371, may be provided with a gear for receiving a driving force from the outside. An agitator 380 is connected to the large diameter part 372. The agitator 380 swivels about the rotary shaft 371, thus agitating toner charged within the toner storage chamber 310 so that the toner does not lump. In addition, the shape-mating parts 374*a*, 374*b*, which are provided between the opposite ends of the large diameter part and the small diameter parts 373*a*, 373*b*, respectively, are spaced from the inner lateral walls 313*a*, 313*b* of the toner housing 310. The cross-sectional shape of the shape-mating parts 374*a*, 374*b* is not limited to a square as shown in FIG. 5, and may be formed in a triangular, a pentagonal, or other polygonal shapes. In the present embodiment, it is illustrated that the cross-sectional area of the large diameter part 372 is larger than those of the shape-mating parts 374*a*, 374*b*, and the cross-sectional areas of the shape-mating parts 374*a*, 374*b* are larger than those of the small diameter parts 373*a*, 374*b*. However, the present invention is not limited thereto. In other words, the rotary shaft 371 according to the present invention may comprise a shaft member having a constant diameter without being divided into the large diameter part 372 and the small diameter parts 373*a*, 373*b*, and the shape-mating parts provided at the opposite ends of the shaft member may have a cross-sectional area larger than that of the shaft member. In this case, the shape-mating parts are also spaced from the opposite inner lateral walls 313*a*, 313*b* of the toner housing 310.

Figure 6A:
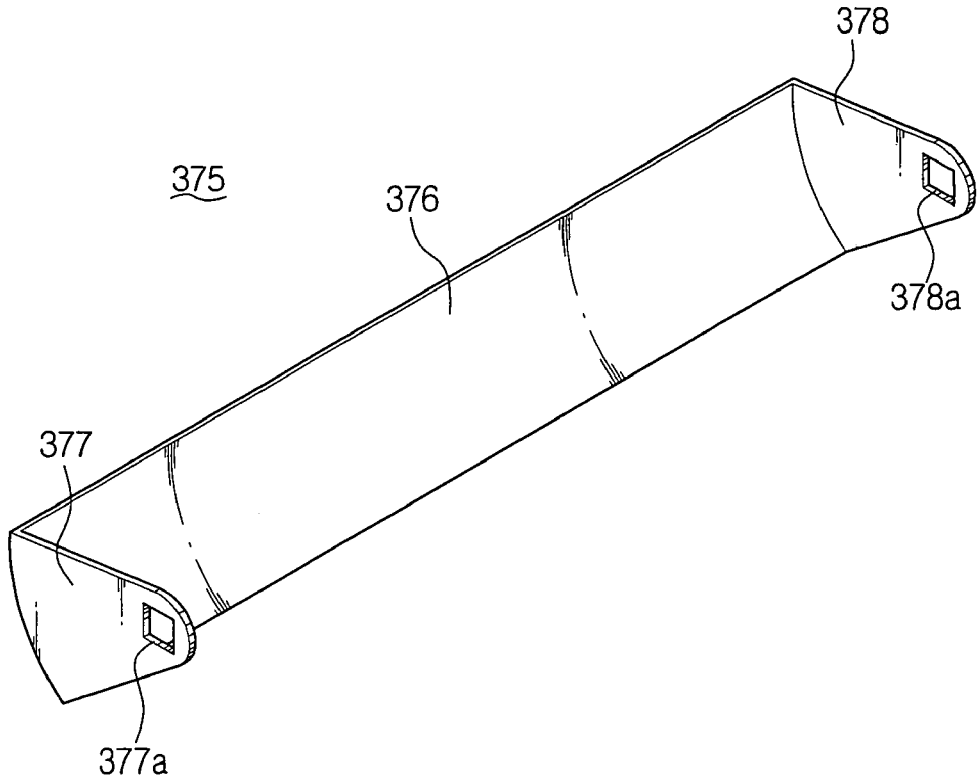
FIGS. 6A and 6B are perspective and front views illustrating a shielding member of the developing cartridge according to an embodiment of the present invention, respectively.
Figure 6B:
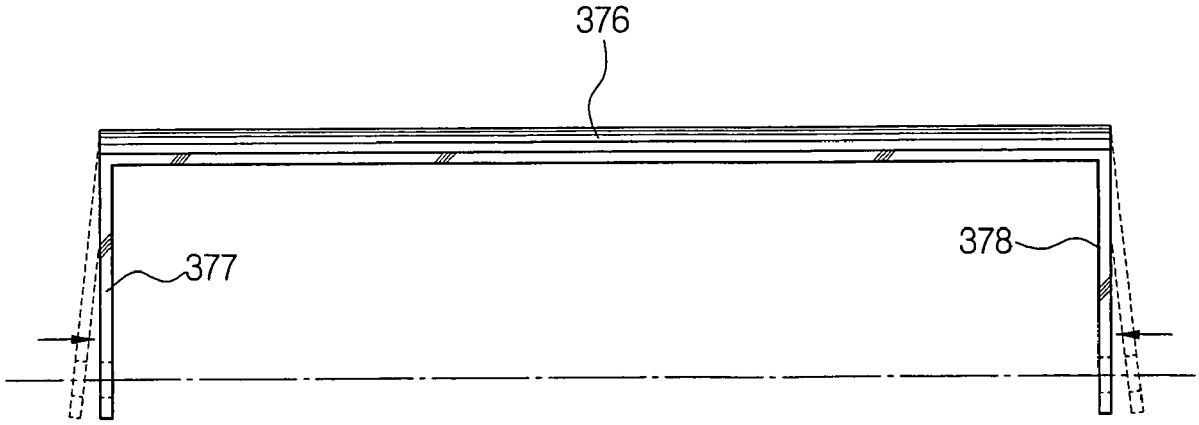

The shielding member 375 includes a shielding section 376 and a pair of swivel supporting sections 377, 378, as shown in FIG. 6A. The shielding section 376 has an area larger than that of the communication hole 310*c* (FIG. 5) so that the former can shield the communication hole 310*c*. The swivel supporting sections 377, 378 are formed at the opposite ends of the shielding section 376, respectively. The swivel parts 377, 378 are formed with shape-mating holes 377*a*, 378*a*, respectively. The shape-mating holes 377*a*, 378*a* may be formed in square, triangle or any other polygonal shape to correspond to the shape-mating parts 374*a*, 374*b*, respectively. If the shape-mating parts 374*a*, 374*b* are mated with the shape-mating holes 377*a*, 377*b*, respectively, the rotary shaft 371 and the shielding member 375 are connected with each other. If the rotary shaft 371 rotates, the shielding member 375 can be swiveled in cooperation with the rotary shaft 371. In addition, the swivel supporting sections 377, 378 are elastically deformable in the longitudinal direction of the shielding section 376, as shown in FIG. 6B. Therefore, the swivel supporting sections 377, 378 are deformed in the inwardly opposite directions when external forces are applied to both of the swivel supporting sections 377, 378 as indicated by arrows, and return to their initial positions shown in solid line in FIG. 6B.

Figure 8:
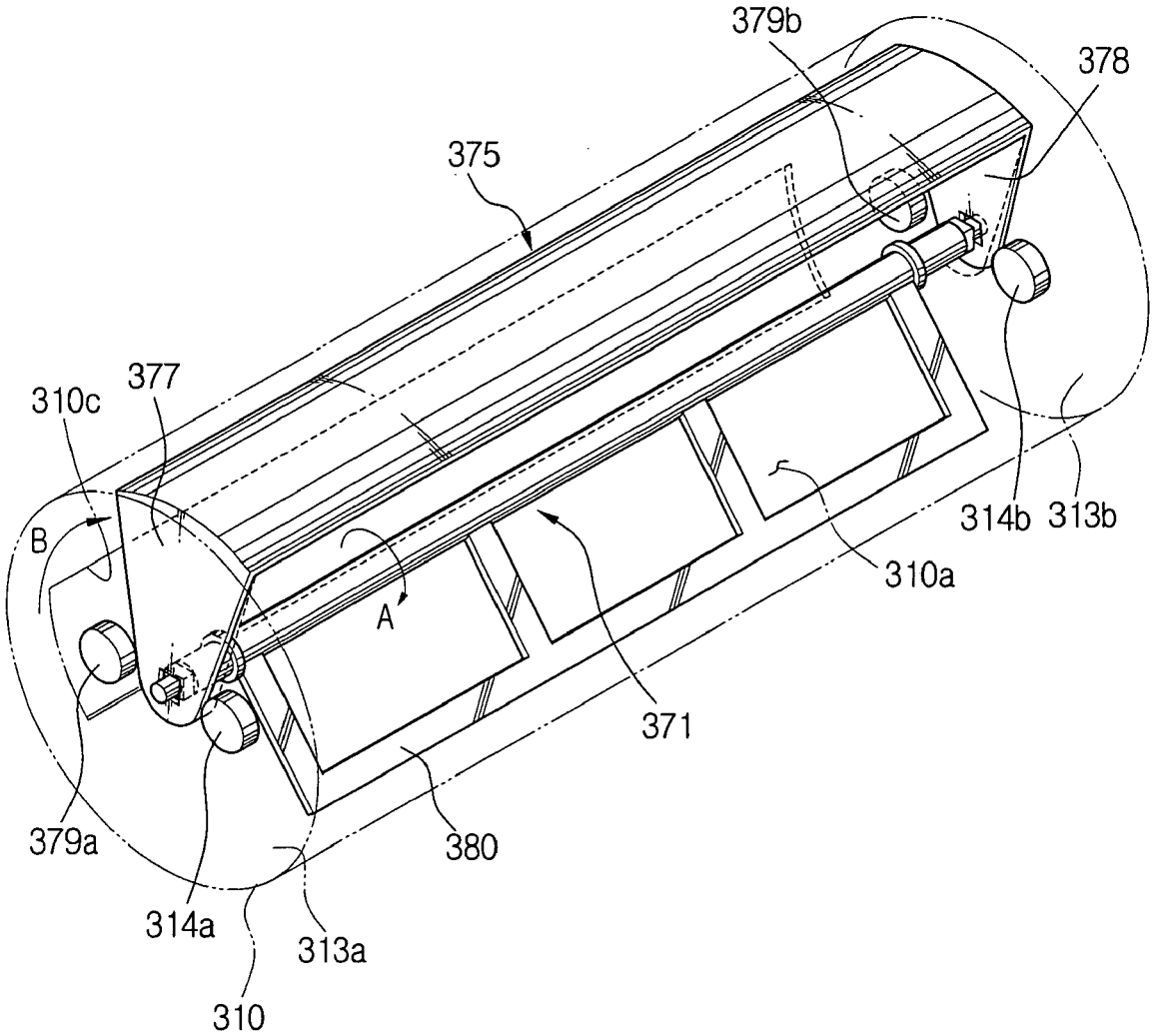

The compression projections 379*a*, 379*b* are provided on the opposite inner lateral walls 313*a*, 313*b* of the toner housing 310, respectively, as shown in FIG. 5. The compression projections 379*a*, 379*b* compress both of the swivel supporting sections 377, 378 of the shielding member 375, so that the shape-mating slots 377*a*, 378*a* are mated with the shape-mating parts 374*a*, 374*b*, respectively. In addition, the compression projections 379*a*, 379*b* cooperate with the fixing projections 314*a*, 314*b* each provided on one of the inner lateral walls 313*a*, 314*b* of the toner housing 310, in such a way of preventing the shielding member 375 from playing. As shown in FIG. 8, when the shielding member 375 is positioned in the open position, the compression projection 379*a* and the fixing projection 314*a* of one inner lateral wall 313*a* of the toner housing 310 support swivel supporting section 377 and the compression projection 379*b* and the fixing projection 314*b* of the other inner lateral wall 313*b* support swivel supporting section 378.

Although it is described that a pair of shape-mating parts 374*a*, 374*b* are provided in the rotary shaft 371 and the shielding member 375 is provided with a pair of shape-mating slots 377*a*, 378*a* corresponding to the shape-mating parts 377, 378, respectively, in the embodiment of the present invention, the present invention is not limited thereto. It is possible to establish connection between the rotary shaft 371 and a shielding member 375 with one shape-mating part and one shape-mating hole.

Hereinbelow, the operation of the developing cartridge 300 according to embodiments of the present invention will be described with reference to the accompanying drawings.

Figure 7:
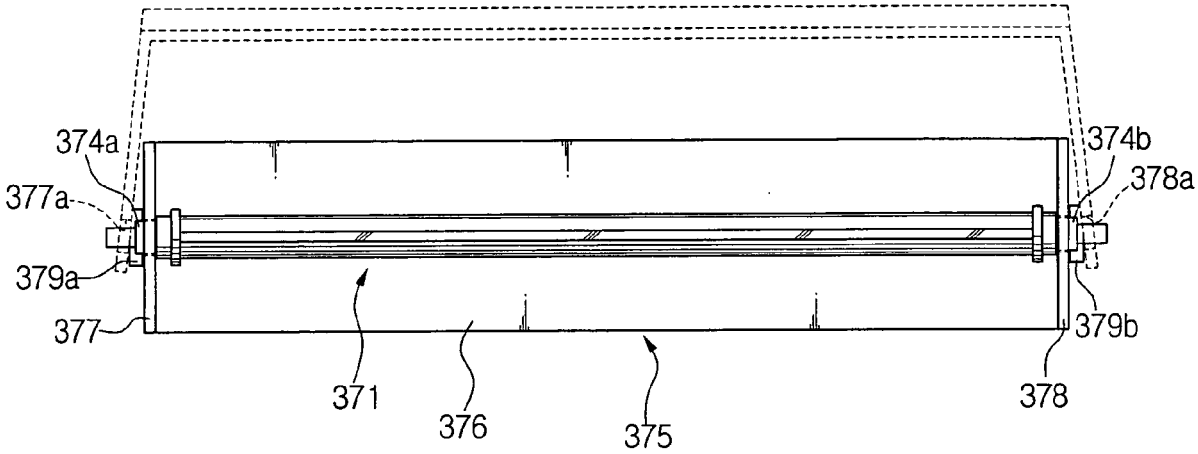
FIGS. 7 and 8 are perspective and front views for describing the operation of the shielding member of the developing cartridge according to an embodiment of the present invention, respectively.

When manufacturing the developing cartridge 300, toner is placed into both of the toner feeding chamber 310*b* and the toner storage chamber 310*a*. At this time, as shown in FIG. 3, the shielding member 375 is disposed in the shielding position for shielding the communication hole 310*c* between the toner feeding chamber 310*b* and the toner storage chamber 310*a*. As a result, the toner in the toner storage chamber 310*a* cannot flow into the toner feeding chamber 310*b* and the toner pressure is low. As shown in greater detail in FIGS. 5 and 7, the opposite swivel supporting sections 377 and 378 of the shielding member 375 are compressed by the compression projections 379*a*, 379*b*, respectively, thereby being elastically deformed, in the case of which the shape-mating holes 377*a*, 378*a* (FIG. 6A) of the swivel supporting sections 377, 378 are mated with the shape-mating parts 374*a*, 374*b*, respectively. When the shielding member 375 is in the shielding position in this manner, the toner in the toner feeding chamber 310*b* seldom flows out of the toner housing through the gap between the developing roller 330 and the restraint blade 311 (FIG. 3) or the gap between the developing roller 330 and the shielding membrane 312 (FIG. 3) although vibration or impact is applied to the developing cartridge when transporting the cartridge 300.

If the rotary shaft 371 receives a driving force through the driving section of the image forming apparatus body 101 and rotates in the direction indicated by arrow A in FIG. 8 after the developing cartridge 300 is mounted to the image forming apparatus body 101 (FIG. 1), the shielding member 375 swivels in the direction indicated by arrow B in cooperation with the rotary shaft 371. If the swivel supporting sections 377, 378 rotate and break away from the compression projections 379*a*, 379*b*, respectively, the shape-mating holes 377*a*, 377*b* of the respective swivel supporting sections 377, 378 break away from the shape-mating parts 374*a*, 374*b*, respectively, as shown in dotted line in FIG. 7. At this time, the shielding section 376 of the shielding member 375 is released from the communication hole 310*c*, by which the communication hole 310*c* is opened. In addition, the connection between the shielding member 375 and the rotary shaft 371 is disengaged, and the shielding member 375 is in the state of idling. Accordingly, the shielding member 375 is not swiveled even if the rotary shaft 371 rotates. When the shielding member 375 is in the opening position as shown in FIG. 8, the compression projections 379*a*, 379*b* and the fixing projections 314*a*, 314*b*, both provided on the opposite inner lateral walls 313*a*, 313*b* of the toner housing 310, support the respective swivel supporting sections 377, 378, thereby preventing the shielding member 375 from moving. Further, the agitator 380 connected to the rotary shaft 371 swivels within the toner storage chamber 310*a* and agitates the toner within the toner storage chamber 310*b* (FIG. 3) in order to prevent the toner from lumping. The toner of the toner storage chamber 310*a* freely moves to the toner feeding chamber 310*b* through the communication hole 310*c*.

Figure 9:
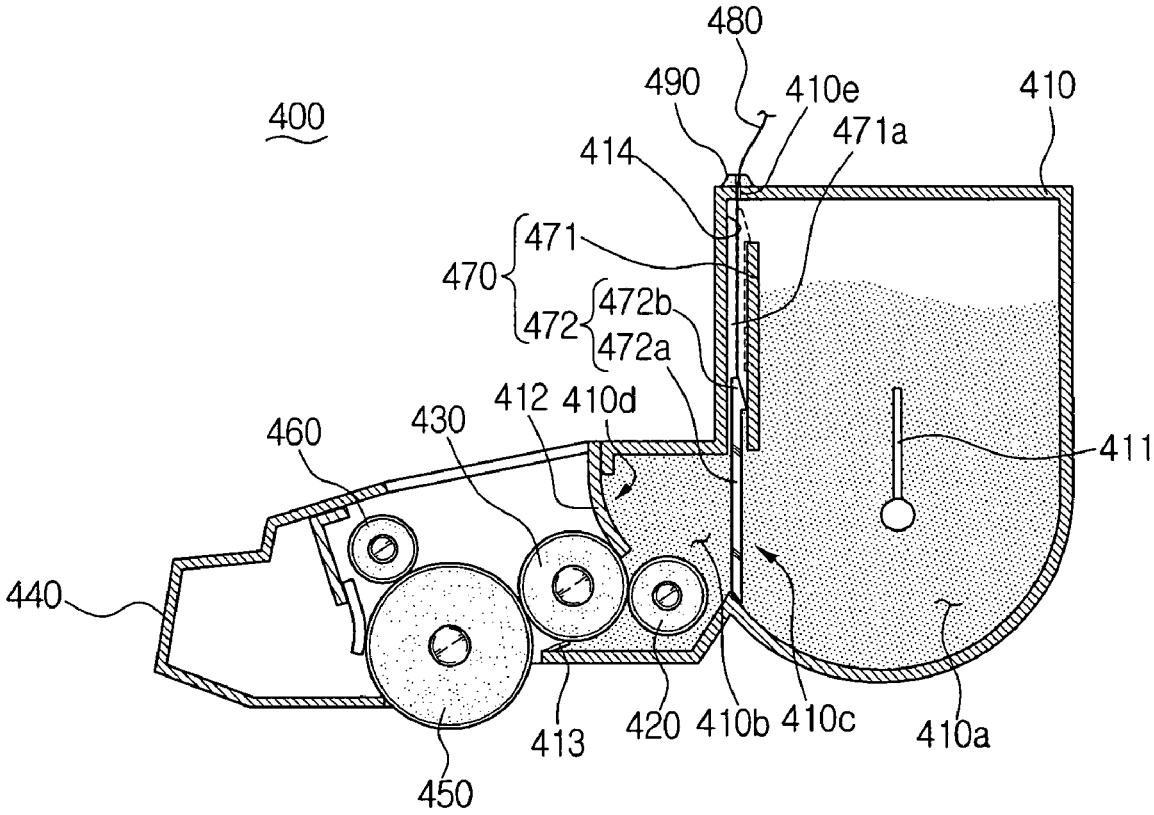
FIG. 9 is a view illustrating a developing cartridge according to another embodiment of the present invention.

FIG. 9 illustrates a developing cartridge according to another embodiment of the present invention.

As shown in FIG. 9, the developing cartridge 400 according to another embodiment of the present invention comprises a toner housing 410, a feeding roller 420, a developing roller 430, a photosensitive drum housing 440, a photosensitive drum 450, an electrification drum 460 and a shielding device 470.

A toner storage chamber 410*a* and a toner feeding chamber 410*b* are provided within the toner housing 410. The toner storage chamber 410*a* and the toner feeding chamber 410*b* communicate with each other through a communication hole 410*c*, and one side of the toner feeding chamber 410*b* has an opening 410*d* for moving the toner out of the toner housing 410. An agitator 411 is rotatably installed within the toner storage chamber 410*a*.

In addition, a feeding roller 420 is installed within the toner feeding chamber 410*b* and a developing roller 430 is installed within the opening 410*d* to be in contact with the feeding roller 420. Installed at one side of the opening 410*d* is a restraint blade 412 that restrains the thickness of the toner deposited on the surface of the developing roller 430 and shields a part of the opening 410*d* along with the developing roller 430. Further, installed to be in contact with the developing roller 430 at the other side of the opening 410*d* is a shielding membrane 413 that shields the other part of the opening 410*d* along with the developing roller 430.

The photosensitive drum housing 440, the photosensitive drum 450 and the electrification roller 460 are similar to those of the aforementioned embodiment, and thus description thereof will be omitted.

The shielding device 470 comprises a guide wall 471 and a shielding member 472. The guide wall 471 is installed within the toner storage chamber 410*a* to be spaced from the inner front wall 414 of the toner housing 410, and a guide slot 471*a* is formed between the guide wall 471 and the inner front wall 414 of the toner housing 410.

The shielding member 472 comprises a shielding section 472*a* and a head section 472*b*. The shielding section 472*a* moves along the guide slot 471*a* and shields the communication hole 410*c*. In addition, the head section 472*b* is provided at the top end of the shielding section 472*a*. The head section 472*b* is arranged in such a way that it is latched onto the top end of the guide wall 471 when the shielding section 472*a* is lifted along the guide slot 471*a* and placed in an opening position for opening the communication hole 410*c*. Accordingly, the shielding member 472 is not able to move downwardly, thereby being anchored in the opening position.

In addition, an operation cable 480 is connected to the head section 472*b* for a user to manipulate. The operation cable 480 is exposed to the outside of the toner housing 410 through a throughhole 410*e* formed at one side of the top of the toner housing 410. The user manipulates the shielding member 472 using the operation cable 480. A sealing member 490 seals the throughhole 410*e*.

With the developing cartridge 400 of the above construction, the shielding member 472 shields the communication hole 410*c* with the toner storage chamber 410*a* and the toner feeding chamber 410*b* filled with the toner. Therefore, the toner does not flow between the toner storage chamber 410*a* and the toner feeding chamber 410*b*, and a low toner pressure is maintained within the toner feeding chamber 410*b*. Accordingly, even if vibration or external impact is applied to the developing cartridge 400 during the transportation of the developing cartridge 400, the toner within the toner feeding chamber 410*b* seldom passes through the gap between the developing roller 430 and the restraint blade 412 or through the gap between the developing roller 430 and the shielding membrane 413. As a result, the toner does not leak out from the toner housing 410.

The user may lift the shielding member 472 using the operation cable 480 after installing the developing cartridge 400 into the image forming apparatus body 101 (FIG. 1). The shielding member 472 is lifted along the guide slot 471*a*, and the communication hole 410*c* is opened. In the opening position of the shielding member 472, the toner within the toner storage chamber 410*a* freely moves to the feeding chamber 410*b*.

As described above, according to the present invention, the shielding members 375, 472 are interposed between the toner storage chambers 310*a*, 410*a* and the toner feeding chambers 310*b*, 410*b*, and therefore, the toner does not move between the toner storage chamber and the toner feeding chamber. Accordingly, since the toner pressure within the toner feeding chamber 310*b*, 410*b*, which has a volume smaller than that of the toner storage chamber 310*a*, 410*a*, is low, the toner within the toner feeding chamber 310*b*, 410*b* seldom passes through the gap between the developing roller 330, 430 and the restraint blade 311, 412 or through the gap between the developing roller 330, 430 and the shielding membrane 312, 413, and also seldom leaks out from the toner housing 310, 410 even if vibration or external impact is applied to the developing cartridge 300, 400 during the transportation of the developing cartridge 300, 400.

In addition, according to the present invention, since not only the toner storage chambers 310*a*, 410*a* but also the toner feeding chambers 310*b*, 410*b* can be filled with toner at the time of manufacturing the developing cartridges 300, 400, toner storage space of the developing cartridge 300, 400 can be increased.

Furthermore, according to the present invention, since the shielding member for shielding a toner storage chamber and a toner-feeding chamber moves between an opening position and a shielding position both located within the toner storage chamber, the user can avoid problems when handling the shielding member.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A developing cartridge for an electrophotographic image forming apparatus, comprising:

a toner housing having a toner storage chamber and an opening at one side thereof;

a toner-feeding chamber formed between the toner storage chamber and the opening;

a communication hole communicating between the toner storage chamber and the toner-feeding chamber;

a feeding roller included in the toner-feeding chamber;

a developing roller included in the opening to contact the feeding roller; and a shielding device included in the toner storage chamber to be moveable from a shielding position, in which the shielding device shields the communication hole, to an open position in which the shielding device opens the communication hole, wherein the shielding device comprises:

a rotary shaft rotatably supported at opposite ends by opposite inner lateral walls of the toner housing;

a shielding member selectively connected to the rotary shaft to open and close the communication hole; and connecting means for selectively connecting the shielding member to the rotary shaft, wherein when the shielding member is connected to the rotary shaft and cooperates with the rotary shaft in the shielding position the shielding member shields the communication hole, and when the shielding member is released from the cooperation with the rotary shaft in the opening position the shielding member opens the communication hole.

2. The developing cartridge according to claim 1, wherein the shielding member comprises a shielding section shielding the communication hole, and a pair of swivel supporting sections engaged to opposite ends of the shielding section, to be elastically deformable, in which at least one of the swivel supporting sections is provided with a shape-mating hole, wherein the connecting means comprises one shape-mating part provided at one end of the rotary shaft on one of the opposite inner lateral walls of the toner housing and compression projections projected from one of the inner lateral walls of the toner housing, and wherein the swivel supporting sections are elastically deformed by the compression projections, and the shape-mating hole is mated with the shape-mating part, thereby being connected to the rotary shaft in the shielding position, and the shape-mating hole is disengaged from the shape-mating part if the swivel supporting sections swivel in cooperation with the rotary shaft and elastically return to the original form, thereby breaking away from the compression projections at the opening position.

3. The developing cartridge according to claim 2, wherein at least one of the opposite inner lateral walls of the toner housing is provided with a fixing projection in order to prevent the swivel supporting sections from being rotated from a state in which the swivel supporting sections break away from the rotary shaft.

4. The developing cartridge according to claim 2, further comprising an agitator connected to the rotary shaft.

5. The developing cartridge according to claim 1, wherein the shielding member comprises a shielding section shielding the communication hole, and a pair of swivel supporting sections engaged to opposite ends of the shielding section, to be elastically deformable, in which at least one of the swivel supporting sections is provided with a shape-mating hole, wherein the connecting means comprises a pair of shape-mating parts provided at opposite ends of the rotary shaft to be spaced from the opposite inner lateral walls of the toner housing, and compression projections projected from the inner lateral walls of the toner housing, and wherein the swivel supporting sections are elastically deformed by the compression projections, and the shape-mating holes are mated with the shape-mating parts, thereby being connected to the rotary shaft in the shielding position, and the shape-mating holes are disengaged from the shape-mating parts if the swivel supporting sections swivel in cooperation with the rotary shaft and elastically return to the original form, thereby breaking away from the compression projections at the opening position.

6. The developing cartridge according to claim 5, wherein at least one of the opposite inner lateral walls of the toner housing is provided with a fixing projection in order to prevent the swivel supporting sections from being rotated from a state where the swivel supporting sections break away from the rotary shaft.

7. The developing cartridge according to claim 5, further comprising an agitator connected to the rotary shaft.

8. The developing cartridge according to claim 1, further comprising:

a restraint blade installed at the opening of the toner housing to shield a part of the opening along with the developing roller; and a shielding membrane installed at the opening of the toner housing to shield a remaining part of the opening along with the developing roller.

9. The developing cartridge according to claim 1, further comprising:

a photosensitive drum housing connected to the toner housing having the opening;

a photosensitive drum installed within the photosensitive drum housing to be fed with toner through the developing roller; and an electrification roller installed within the photosensitive drum housing to electrify the photosensitive drum.

10. A developing cartridge for an electrophotographic image forming apparatus, comprising:

a toner housing having a toner storage chamber and an opening at one side thereof;

a toner-feeding chamber formed between the toner storage chamber and the opening;

a communication hole communicating between the toner storage chamber and the toner-feeding chamber;

a feeding roller included in the toner-feeding chamber;

a developing roller included in the opening to contact the feeding roller; and a shielding device included in the toner storage chamber to be moveable from a shielding position, in which the shielding device shields the communication hole, to an open position in which the shielding device opens the communication hole, wherein the shielding device comprises:

a guide wall installed in the toner storage chamber so that a guide slot is formed between an inner front wall of the toner housing and the guide wall; and a shielding member installed to vertically move along the guide slot, wherein the shielding member comprises:

a shielding section for shielding the communication hole; and a head section provided at a top of the shielding section, the head section being arranged so that it is latched onto at least one of the inner front wall and the guide wall in the opening position where the communication hole is opened as the shielding section is upwardly moved along the guide slot.

11. The developing cartridge according to claim 10, wherein one side of the toner housing is formed with a throughhole, and an operation cable is connected to the head section, the operation cable being exposed to the outside of the toner housing through the through hole.

12. The developing cartridge according to claim 11, wherein a sealing member is provided on at least one of an inner and outer portions of the toner housing to seal the throughhole.

13. The developing cartridge according to claim 10, wherein an agitator is installed within the toner storage chamber.

14. A cartridge comprising:

a toner housing comprising a toner storage chamber and a toner feeding chamber, the toner storage chamber having an opening at one side thereof;

a communication hole communicating the toner storage chamber with the toner feeding chamber; and a guarding device located in the toner storage chamber moveable from a guarding position closing the communication hole to an open position opening the communication hole, wherein the guarding device comprises:

a rotary shaft rotatably supported at opposite ends by inner lateral walls of the toner housing; and a guarding member connected to the rotary shaft to open and close the communication hole; and a connector connecting the guarding member to the rotary shaft.

15. The cartridge according to claim 14, wherein the guarding member comprises a guarding section for guarding the communication hole, and a pair of swivel supporting sections engaged to opposite ends of the guarding section, to be elastically deformable, in which at least one of the swivel supporting sections is provided with a shape-mating hole, wherein the connector comprises one shape-mating part provided at one end of the rotary shaft and compression projections projecting from one of the inner lateral walls of the toner housing, and wherein the swivel supporting sections are elastically deformed by the compression projections, and the shape-mating hole is mated with the shape-mating part, thereby being connected to the rotary shaft in the guarding position, and the shape-mating hole is disengaged from the shape-mating part if the swivel supporting sections swivel in cooperation with the rotary shaft and elastically return to the original form, thereby breaking away from the compression projections at the opening position.

16. The cartridge according to claim 15, wherein at least one of the opposite inner lateral walls of the toner housing is provided with a fixing projection in order to prevent the swivel supporting sections from being rotated from a state where the swivel supporting sections break away from the rotary shaft.

17. The cartridge according to claim 15, further comprising an agitator connected to the rotary shaft.

18. The cartridge according to claim 14, wherein the guarding member comprises a guarding section for covering the communication hole, and a pair of swivel supporting sections engaged to opposite ends of the guarding section, to be elastically deformable, in which at least one of the swivel supporting sections is provided with a shape-mating hole, wherein the connector comprises a pair of shape-mating parts provided at opposite ends of the rotary shaft to be spaced from the inner later walls of the toner housing, and compression projections projecting from the inner lateral walls of the toner housing, and wherein the swivel supporting sections are elastically deformed by the compression projections, and the shape-mating holes are mated with the shape-mating parts, thereby being connected to the rotary shaft in the guarding position, and the shape-mating holes are disengaged from the shape-mating parts if the swivel supporting sections swivel in cooperation with the rotary shaft and elastically return to the original form, thereby breaking away from the compression projections at the opening position.

19. The cartridge according to claim 18, wherein at least one of the inner lateral walls of the toner housing is provided with a fixing projection to prevent the swivel supporting sections from being rotated from a state where the swivel supporting sections breaks away from the rotary shaft.

20. The cartridge according to claim 18, further comprising an agitator connected to the rotary shaft.

21. The cartridge according to claim 14, further comprising:

a restraint blade installed at the opening of the toner housing to close a part of the opening along with a developing roller; and a guarding membrane installed at the opening of the toner housing to close a remaining part of the opening along with the developing roller.

22. The cartridge according to claim 14, further comprising:

a photosensitive drum housing connected to the toner housing;

a photosensitive drum installed within a photosensitive drum housing to be fed with toner through a developing roller; and an electrification roller installed within the photosensitive drum housing to electrify the photosensitive drum.

23. A cartridge comprising:

a toner housing comprising a toner storage chamber and a toner feeding chamber, the toner storage chamber having an opening at one side thereof;

a communication hole communicating the toner storage chamber with the toner feeding chamber; and a guarding device located in the toner storage chamber moveable from a guarding position closing the communication hole to an open position opening the communication hole, wherein the shielding device comprises:

a guide wall installed in the toner storage chamber so that a guide slot is formed between an inner front wall of the toner housing and the guide wall; and a guarding member installed to vertically move along the guide slot, wherein the guarding member comprises:

a guarding section closing the communication hole; and a head section provided at a top of the guarding section, the head section being arranged so that it is latched onto at least one of the inner front wall and the guide wall in the opening position where the communication hole is opened as the guarding section is upwardly moved along the guide slot.

24. The cartridge according to claim 23, wherein one side of the toner housing is formed with a through hole, and an operation cable is connected to the head section, the operation cable being exposed to the outside of the toner housing through the through hole.

25. The cartridge according to claim 24, wherein a sealing member is provided on at least one of an inner and outer portions of the toner housing to seal the through hole.

26. The cartridge according to claim 23, wherein an agitator is installed within the toner storage chamber.

* * * * *

UNITED STATES PATENT AND TRADEMARK OFFICE

CERTIFICATE OF CORRECTION

PATENT NO. : 7,110,708 B2
APPLICATION NO. : 10/873108
DATED : September 19, 2006
INVENTOR(S) : In-cheol Jeon It is certified that error appears in the above-identified patent and that said Letters Patent is hereby corrected as shown below:

Column 11, Line 27, change “through hole.” to --throughhole.--

Signed and Sealed this

Thirteenth Day of February, 2007

JON W. DUDAS
*Director of the United States Patent and Trademark Office*